US008568199B2

(12) United States Patent
Ohta et al.

(10) Patent No.: US 8,568,199 B2
(45) Date of Patent: Oct. 29, 2013

(54) POLISHING ENDPOINT DETECTION APPARATUS

(75) Inventors: Shinrou Ohta, Tokyo (JP); Atsushi Shigeta, Kanagawa (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 504 days.

(21) Appl. No.: 12/897,973

(22) Filed: Oct. 5, 2010

(65) Prior Publication Data

US 2011/0081829 A1 Apr. 7, 2011

(30) Foreign Application Priority Data

Oct. 6, 2009 (JP) ..... 2009-232135

(51) Int. Cl.
*B24B 49/00* (2012.01)
*B24B 51/00* (2006.01)

(52) U.S. Cl.
USPC ..... 451/6; 451/8; 451/10; 451/288

(58) Field of Classification Search
USPC ..... 250/339.07, 339.11, 559.27; 356/381, 356/382; 451/6, 8, 10, 11, 36, 41, 285, 286, 451/287, 288, 290
See application file for complete search history.

(56) References Cited

U.S. PATENT DOCUMENTS

| | | | | |
|---|---|---|---|---|
| 6,271,047 | B1 | 8/2001 | Ushio et al. | |
| 6,489,624 | B1 * | 12/2002 | Ushio et al. | 250/559.27 |
| 7,438,627 | B2 | 10/2008 | Kobayashi et al. | |
| 7,446,889 | B2 | 11/2008 | Fujikake | |
| 8,388,408 | B2 * | 3/2013 | Kobayashi et al. | 451/5 |
| 2009/0233525 | A1 | 9/2009 | Ueda et al. | |

FOREIGN PATENT DOCUMENTS

| | | |
|---|---|---|
| JP | 2000-033561 | 2/2000 |
| JP | 2000-040680 | 2/2000 |
| JP | 2004-154928 | 6/2004 |
| JP | 2005-244047 | 9/2005 |

* cited by examiner

*Primary Examiner* — Timothy V Eley
(74) *Attorney, Agent, or Firm* — Wenderoth, Lind & Ponack, L.L.P.

(57) ABSTRACT

Method and apparatus for detecting an accurate polishing endpoint of a substrate based on a change in polishing rate are provided. The method includes: applying a light to the surface of the substrate and receiving a reflected light from the substrate; obtaining a plurality of spectral profiles at predetermined time intervals, each spectral profile indicating reflection intensity at each wavelength of the reflected light; selecting at least one pair of spectral profiles, including a latest spectral profile, from the plurality of spectral profiles obtained; calculating a difference in the reflection intensity at a predetermined wavelength between the spectral profiles selected; determining an amount of change in the reflection intensity from the difference; and determining a polishing endpoint based on the amount of change.

11 Claims, 14 Drawing Sheets

POLISHING ENDPOINT DETECTION APPARATUS

BACKGROUND OF THE INVENTION

1. Field of the Invention

The present invention relates to a method and an apparatus for detecting a polishing endpoint of a substrate having an insulating film, and more particularly to a method and an apparatus for detecting a polishing endpoint based on reflected light from a substrate.

2. Description of the Related Art

In fabrication processes of a semiconductor device, various kinds of materials are repeatedly deposited as films on a silicon wafer to form a multilayer structure. For the formation of such a multilayer structure, it is important to planarize a surface of a top layer. A polishing apparatus configured to perform chemical mechanical polishing (CMP) is used as one of techniques for achieving such planarization.

The polishing apparatus of this type includes, typically, a polishing table supporting a polishing pad thereon, a top ring for holding a substrate (a wafer with a film formed thereon), and a polishing liquid supply mechanism for supplying a polishing liquid onto the polishing pad. Polishing of a substrate is performed as follows. The top ring presses the substrate against the polishing pad, while the polishing liquid supply mechanism supplies the polishing liquid onto the polishing pad. In this state, the top ring and the polishing table are moved relative to each other to polish the substrate, thereby planarizing the film of the substrate. The polishing apparatus typically includes a polishing endpoint detection unit. This polishing endpoint detection unit is configured to determine a polishing endpoint from a time when the film is removed until a predetermined thickness is reached or when the film in its entirety is removed.

One example of such polishing endpoint detection unit is a so-called optical polishing endpoint detection apparatus, which is configured to apply a light to a surface of a substrate and determine a polishing endpoint based on information contained in the reflected light from the substrate. The optical polishing endpoint detection apparatus typically includes a light-applying section, a light-receiving section, and a spectroscope. The spectroscope decomposes the reflected light from the substrate according to wavelength and measures reflection intensity at each wavelength. This optical polishing endpoint detection apparatus is often used in polishing of a substrate having a light-transmittable film. For example, the Japanese laid-open patent publication No. 2004-154928 discloses a method in which intensity of reflected light from a substrate (i.e., reflection intensity) is subjected to certain processes for removing noise components to create a characteristic value and the polishing endpoint is detected from a distinctive point (a local maximum point or a local minimum point) of a temporal variation in the characteristic value.

The characteristic value created from the reflection intensity varies periodically with polishing time as shown in FIG. 1, and local maximum points and local minimum points appear alternately. This phenomenon is due to interference between light waves. Specifically, the light, applied to the substrate, is reflected off an interface between a medium and a film and an interface between the film and an underlying base layer of the film. The light waves reflected from these interfaces interfere with each other. The manner of interference between the light waves varies depending on the thickness of the film (i.e., a length of an optical path). Therefore, the intensity of the reflected light from the substrate (i.e., the reflection intensity) changes periodically in accordance with the thickness of the film. The reflection intensity can also be expressed as a reflectance.

As shown in FIG. 1, the above-described optical polishing endpoint detection apparatus counts the number of distinctive points (i.e., the local maximum points or local minimum points) of the variation in the characteristic value after the polishing process is started, and detects a point of time when the number of distinctive points has reached a preset value. Then, the polishing process is stopped after a predetermined period of time has elapsed from the detected point of time.

The characteristic value is an index (a spectral index) obtained based on the reflection intensity measured at each wavelength. Specifically, the characteristic value is given by the following equation (1):

$$\text{Characteristic value (Spectral Index)} = ref(\lambda 1)/(ref(\lambda 1)+ref(\lambda 2)+\ldots+ref(\lambda k)) \quad (1)$$

In this equation (1), $\lambda$ represents a wavelength of the light, and ref ($\lambda$k) represents a reflection intensity at a wavelength $\lambda$k. The number of wavelengths $\lambda$ to be used in calculation of the characteristic value is preferably two or three (i.e., k=2 or 3).

As can be seen from the equation (1), the reflection intensity is divided by the refection intensity. This operation can remove noise components contained in the reflection intensity. Therefore, the characteristic value with less noise components can be obtained. Instead of the characteristic value, the reflection intensity (or reflectance) itself may be monitored. In this case also, since the reflection intensity changes periodically according to the polishing time in the same manner as the graph shown in FIG. 1, the polishing endpoint can be detected based on the change in the reflection intensity.

In a polishing process for the purpose of exposing a lower film by polishing an upper film, it is customary to prepare a polishing liquid such that a polishing rate of the lower film is lower than that of the upper film. This is for preventing excessive-polishing of the lower film so as to stabilize the polishing process. However, when the polishing rate is low, the characteristic value (or the reflection intensity) does not fluctuate greatly, as shown in FIG. 2. As a result, the periodical change in the characteristic value is hardly observed and it is therefore difficult to detect the distinctive point (the local maximum point or local minimum point) of the characteristic value. Consequently, an accurate polishing endpoint detection cannot be achieved. In addition, since the fluctuation of the characteristic value (or the reflection intensity) is affected by the thickness of both the upper film and the lower film and the types of films, variation in the initial film thickness between substrates may cause an error of the polishing endpoint detection. Generally, the variation in the initial film thickness between substrates in each process lot is about ±10%. Such variation in the initial film thickness can cause an error of the polishing endpoint detection, because a relationship between the distinctive point of the characteristic value (or the reflection intensity) and the exposure point of the lower film may be altered due to the variation in the thickness of the lower film between substrates.

SUMMARY OF THE INVENTION

The present invention has been made in view of the above. It is therefore an object of the present invention to provide a polishing endpoint detection method and a polishing endpoint detection apparatus capable of detecting an accurate polishing endpoint utilizing a change (decrease) in polishing rate.

One aspect of the present invention for achieving the above object is to provide a method of detecting a polishing endpoint of a substrate. The method includes: polishing a surface of the substrate having a film with a polishing pad; applying a light to the surface of the substrate and receiving a reflected light from the substrate; obtaining a plurality of spectral profiles at predetermined time intervals, each spectral profile indicating reflection intensity at each wavelength of the reflected light; selecting at least one pair of spectral profiles, including a latest spectral profile, from the plurality of spectral profiles obtained; calculating a difference in the reflection intensity at least one predetermined wavelength between the spectral profiles selected; determining an amount of change in the reflection intensity from the difference; and determining a polishing endpoint based on the amount of change.

In a preferred aspect of the present invention, the determining of the polishing endpoint comprises determining a polishing endpoint by detecting that the amount of change has reached a predetermined threshold value.

In a preferred aspect of the present invention, the determining of the amount of change comprises determining an amount of change in the reflection intensity by squaring the difference in the reflection intensity.

In a preferred aspect of the present invention, the at least one predetermined wavelength is a plurality of predetermined wavelengths; and the determining of the amount of change comprises determining an amount of change in the reflection intensity from a sum of differences in the reflection intensity at the plurality of predetermined wavelengths.

In a preferred aspect of the present invention, the at least one pair of spectral profiles comprises a plurality of pairs of spectral profiles, each pair including the latest spectral profile; the calculating of the difference in the reflection intensity comprises calculating a difference in the reflection intensity at the predetermined wavelength between the spectral profiles in each of the plurality of pairs to obtain a plurality of differences in the reflection intensity for the plurality of pairs of spectral profiles; the determining of the amount of change in the reflection intensity comprises determining a plurality of amounts of change in the reflection intensity from the plurality of differences and calculating an average or a sum of the plurality of amounts of change; and the determining of the polishing endpoint comprises determining a polishing endpoint based on the average or sum.

In a preferred aspect of the present invention, the at least one pair of spectral profiles comprises a plurality of pairs of spectral profiles, each pair including the latest spectral profile; the calculating of the difference in the reflection intensity comprises calculating a difference in the reflection intensity at the predetermined wavelength between the spectral profiles in each of the plurality of pairs to obtain a plurality of differences in the reflection intensity for the plurality of pairs of spectral profiles; the determining of the amount of change in the reflection intensity comprises determining a plurality of amounts of change in the reflection intensity from the plurality of differences; and the determining of the polishing endpoint comprises determining a polishing endpoint by detecting that at least one of the plurality of amounts of change has reached a predetermined threshold value.

In a preferred aspect of the present invention, the method further includes creating a spectral index for each of the selected spectral profiles by dividing reflection intensity at the predetermined wavelength by reflection intensity at another wavelength, wherein the calculating of the difference in the reflection intensity comprises calculating a difference in the spectral index between the spectral profiles selected, and wherein the determining of the amount of change in the reflection intensity comprises determining an amount of change in the reflection intensity from the difference in the spectral index.

In a preferred aspect of the present invention, the method further includes differentiating the amount of change in the reflection intensity that varies with polishing time to obtain a derivative value, wherein the determining of the polishing endpoint comprises determining a polishing endpoint based on the amount of change in the reflection intensity and the derivative value.

In a preferred aspect of the present invention, the predetermined time intervals are established such that a phase difference between the spectral profiles selected is approximately a half cycle.

In a preferred aspect of the present invention, the predetermined wavelength is selected from a wavelength range which is such that the phase difference between the spectral profiles selected is approximately a half cycle.

Another aspect of the present invention is to provide an apparatus for detecting a polishing endpoint of a substrate. The apparatus includes: a light-applying unit configured to apply a light to a surface of the substrate having a film; a light-receiving unit configured to receive a reflected light from the substrate; a spectroscope configured to obtain a plurality of spectral profiles at predetermined time intervals, each spectral profile indicating reflection intensity at each wavelength of the reflected light; and a monitoring unit configured to monitor an amount of change in the reflection intensity obtained from the plurality of spectral profiles, wherein the monitoring unit is configured to select at least one pair of spectral profiles, including a latest spectral profile, from the plurality of spectral profiles obtained, calculate a difference in the reflection intensity at least one predetermined wavelength between the spectral profiles selected, determine the amount of change in the reflection intensity from the difference, and determine a polishing endpoint based on the amount of change.

Still another aspect of the present invention is to provide a polishing apparatus including: a polishing table for supporting a polishing pad; a top ring configured to press a substrate having a film against the polishing pad; and the apparatus for detecting a polishing endpoint of the substrate.

The decrease in the amount of change in the reflection intensity means a decrease in polishing rate. Further, the decrease in polishing rate can be regarded as exposure of a lower layer of the film as a result of polishing of the film. Therefore, according to the present invention, the polishing endpoint can be determined by monitoring the amount of change in the reflection intensity during polishing.

DETAILED DESCRIPTION OF THE PREFERRED EMBODIMENT

Figure 1:
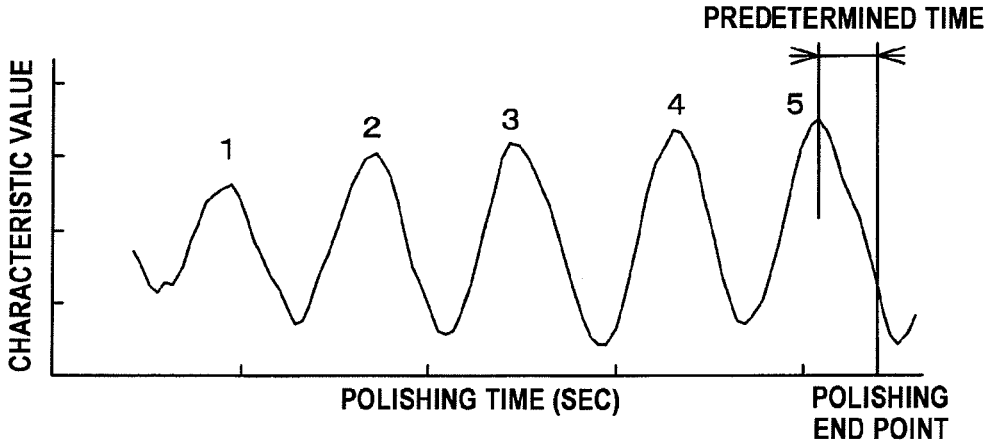
FIG. 1 is a graph showing a manner of change in characteristic value with polishing time.
Figure 2:
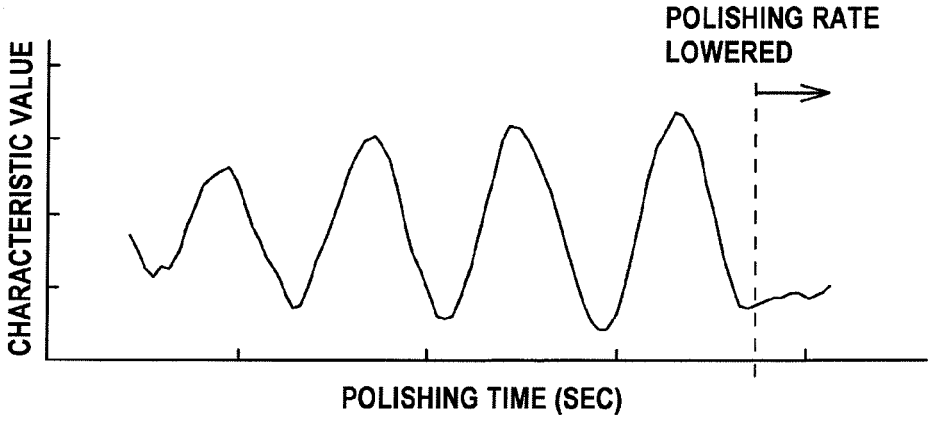
FIG. 2 is a graph showing the characteristic value when a polishing rate is low.
Figure 3A:
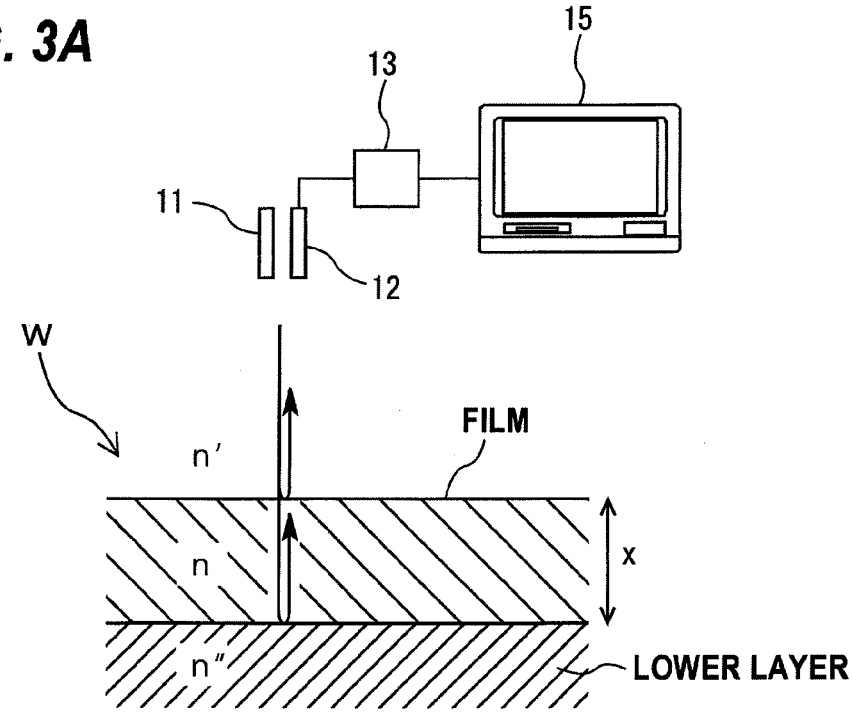
FIG. 3A is a schematic view for explaining a polishing endpoint detection method according to an embodiment of the present invention.
Figure 3B:
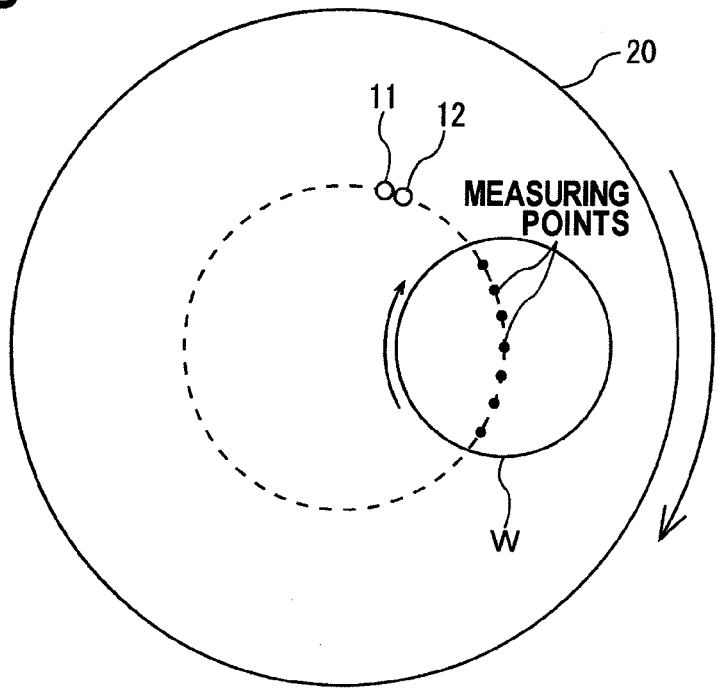
FIG. 3B is a plan view showing a positional relationship between a substrate and a polishing table.

An embodiment of the present invention will be described below with reference to the drawings. FIG. 3A is a schematic view for explaining a polishing endpoint detection method according to an embodiment of the present invention, and FIG. 3B is a plan view showing a positional relationship between a substrate and a polishing table. As shown in FIG. 3A, a substrate W to be polished has a lower layer (e.g., a silicon layer or a SiN film) and a film (e.g., an insulating film, such as $SiO_2$, having a light-transmittable property) formed on the underlying lower layer. A light-applying unit 11 and a light-receiving unit 12 are arranged so as to face a surface of the substrate W. During polishing of the substrate W, the polishing table 20 and the substrate W are rotated, as shown in FIG. 3B, to provide relative movement between a polishing pad (not shown) on the polishing table 20 and the substrate W to thereby polish the surface of the substrate W.

The light-applying unit 11 is configured to apply light in a direction substantially perpendicular to the surface of the substrate W, and the light-receiving unit 12 is configured to receive the reflected light from the substrate W. The light-applying unit 11 and the light-receiving unit 12 are moved across the substrate W each time the polishing table 20 makes one revolution. During the revolution, the light-applying unit 11 applies the light to plural measuring points including the center of the substrate W, and the light-receiving unit 12 receives the reflected light from the substrate W. A spectroscope 13 is coupled to the light-receiving unit 12. This spectroscope 13 is configured to measure the intensity of the reflected light at each wavelength (i.e., measures the reflection intensities or the reflectances at respective wavelengths). More specifically, the spectroscope 13 decomposes the reflected light according to the wavelength and produces a spectral profile (spectral waveform) indicating the reflection intensity at each wavelength. A monitoring unit 15 is coupled to the spectroscope 13, and the spectral profile is monitored by the monitoring unit 15.

The spectral profile is obtained each time the polishing table 20 makes one revolution. Typically, the polishing table 20 rotates at a constant speed during polishing of the substrate W. Therefore, spectral profiles are obtained at equal time intervals which are determined by a rotational speed of the polishing table 20. The spectral profile may be obtained each time the polishing table 20 makes a predetermined number of revolutions (e.g., two or three revolutions).

In FIG. 3A, n represents a refractive index of the film, n' represents a refractive index of a medium contacting the film, and n" represents a refractive index of the lower layer (base layer). Where the refractive index n of the film is larger than the refractive index n' of the medium and the refractive index n" of the lower layer is larger than the refractive index n of the film (i.e., $n'<n<n''$), a phase of light reflected off an interface between the medium and the film and a phase of light reflected off an interface between the film and the lower layer are shifted from a phase of the incident light by $\pi$. Since the reflected light from the substrate is composed of the light wave reflected off the interface between the medium and the film and the light wave reflected off the interface between the film and the lower layer, the intensity of the reflected light from the substrate varies depending on a phase difference between the two light waves. Therefore, the reflection intensity changes periodically according to a change in the thickness X of the film (i.e., a length of an optical path).

Figure 4:
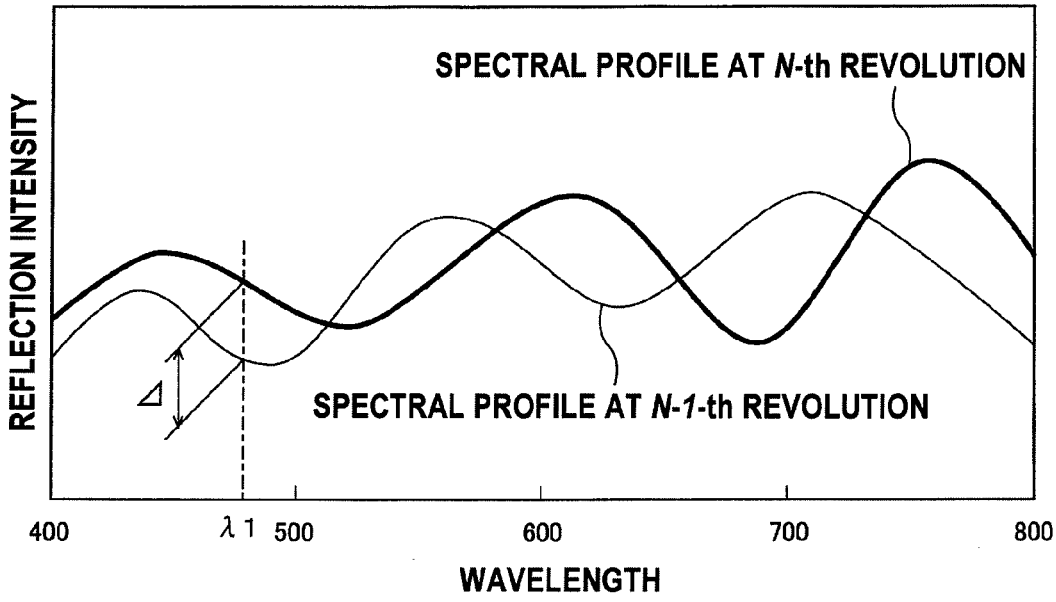
FIG. 4 is a graph showing a spectral profile obtained when the polishing table is making N−1-th revolution and a spectral profile obtained when the polishing table is making N-th revolution.

FIG. 4 is a graph showing a spectral profile obtained when the polishing table is making N−1-th revolution and a spectral profile obtained when the polishing table is making N-th revolution. In the graph shown in FIG. 4, a horizontal axis represents wavelength and a vertical axis represents reflection intensity. As can be seen from FIG. 4, the spectral profile is a distribution of the reflection intensities according to the wavelength of the reflected light. During polishing of the substrate, the spectral profile varies according to a decrease in thickness of the film. As shown in FIG. 4, the spectral profile obtained when the polishing table 20 is making N−1-th revolution differs in shape in its entirety from the spectral profile obtained when the polishing table 20 is making N-th revolution. This indicates a fact that the reflection intensity varies depending on the film thickness.

When the upper film is removed by polishing and the lower layer is exposed, a polishing rate (also referred to as a removal rate) may be extremely lowered. When the polishing rate is lowered, a change in shape of the spectral profile becomes small. Thus, in the present embodiment, the respective spectral profiles obtained at predetermined time intervals are compared successively by the monitoring unit 15, so that a change in the polishing rate is monitored. Specifically, the monitoring unit 15 selects two spectral profiles from a plurality of spectral profiles obtained during polishing, and as shown in FIG. 4, the monitoring unit 15 calculates a difference $\Delta$ in the reflection intensity at a predetermined wavelength $\lambda 1$ between these two spectral profiles. Further, the monitoring unit 15 squares the resultant difference Δ to thereby determine an amount of change in the reflection intensity which is an index showing the change in shape of the spectral profile. By squaring the difference Δ, a magnitude of the difference can be emphasized and besides the amount of change having no minus sign can be obtained.

One of the selected two spectral profiles is the latest spectral profile. Each time a new spectral profile is obtained, two spectral profiles to be compared are specified and the difference Δ in the reflection intensity at the predetermined wavelength λ1 is obtained. During polishing, specifying of the spectral profiles and calculation of the amount of change in the reflection intensity are repeated. The time intervals between the two spectral profiles to be compared are kept constant through the polishing process. The time intervals can be determined in association with the number of revolutions of the polishing table 20. Specifically, when the latest spectral profile is obtained when the polishing table 20 is making N-th revolution, the other spectral profile to be selected is a spectral profile obtained when the polishing table 20 is making N−t-th revolution. This parameter t is a difference in the number of revolutions of the polishing table 20, and the parameter t is a natural number.

Figure 5:
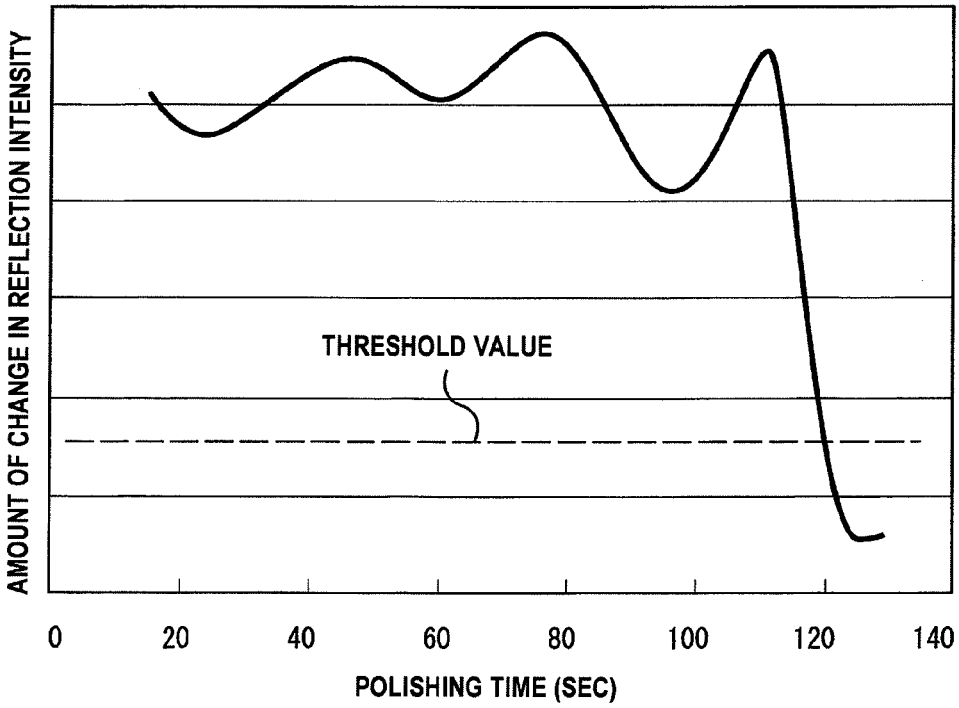
FIG. 5 is a graph showing a manner in which an amount of change in reflection intensity fluctuates according to polishing time.

FIG. 5 is a graph showing a manner in which the amount of change in the reflection intensity fluctuates according to polishing time. In the graph shown in FIG. 5, a horizontal axis represents the polishing time and a vertical axis represents the amount of change in the reflection intensity (square of the difference Δ). As shown in FIG. 5, the amount of change in the reflection intensity fluctuates with the polishing time and decreases sharply at a certain point of time. This indicates the fact that the polishing rate is greatly lowered as a result of removal of the upper film by polishing. Therefore, the removal of the upper film, i.e., the polishing endpoint, can be determined by detecting that the amount of change in the reflection intensity is lowered to reach a predetermined threshold value.

The above-described polishing endpoint detection is performed with respect to the multiple measuring points (see FIG. 3B) which are predetermined on the surface, to be polished, of the substrate W. The polishing endpoint of the substrate W can be determined based on results of the polishing endpoint detection at the respective measuring points. For example, a point of time when the polishing endpoint is detected at the aforementioned multiple measuring points or at any one of the measuring points can be determined to be the polishing endpoint of the substrate W. Alternatively an average of the amounts of change in the reflection intensity at the multiple measuring points may be calculated, and a point of time when the average has reached a predetermined threshold value may be determined to be the polishing endpoint of the substrate W. Alternatively, averages of the amounts of change in the reflection intensity with respect to plural groups of measuring points preselected from the above-mentioned multiple measuring points may be calculated, and a point of time when all of the averages or any one of the averages has reached a predetermined threshold value can be determined to be the polishing endpoint of the substrate W.

Figure 6:
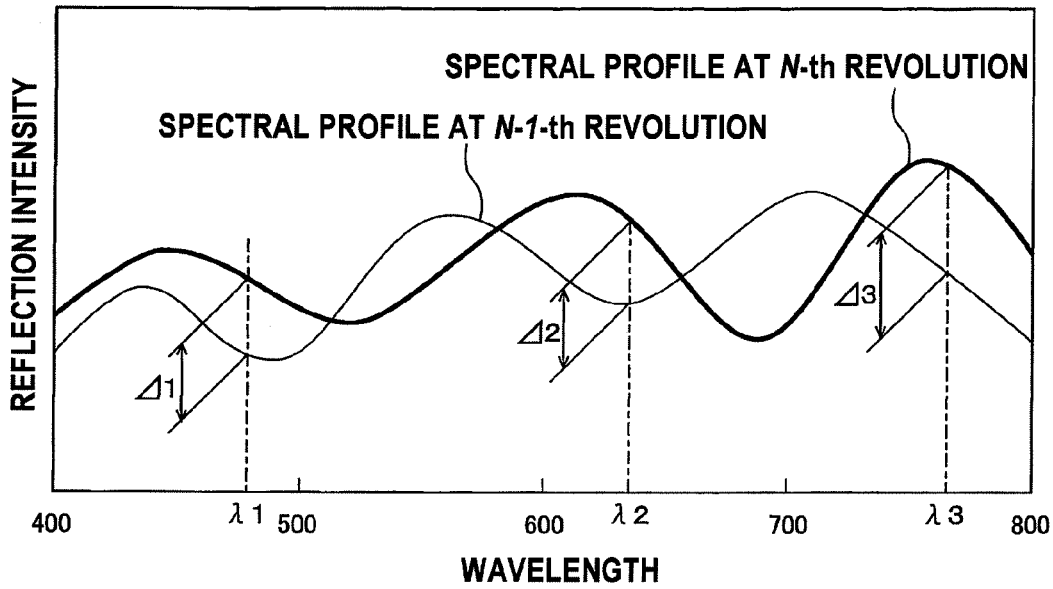
FIG. 6 is a graph showing multiple differences in reflection intensity at multiple wavelengths.

In order to monitor an accurate amount of change in the reflection intensity, it is preferable to calculate the difference in the reflection intensity over a wide range of the wavelength. Therefore, it is preferable that the above-described predetermined wavelength be a plurality of wavelengths. FIG. 6 is a graph showing plural differences in the reflection intensity at multiple wavelengths. In the example shown in FIG. 6, differences Δ1, Δ2, and Δ3 in the reflection intensity at predetermined three wavelengths λ1, λ2, and λ3 are calculated. Each of these differences is squared, and the resultant differences are added to each other. The value (i.e., the sum) obtained as a result of the addition is an amount of change in the reflection intensity. While three wavelengths are selected in the example of FIG. 6, it is preferable to select more wavelengths.

Figure 7:
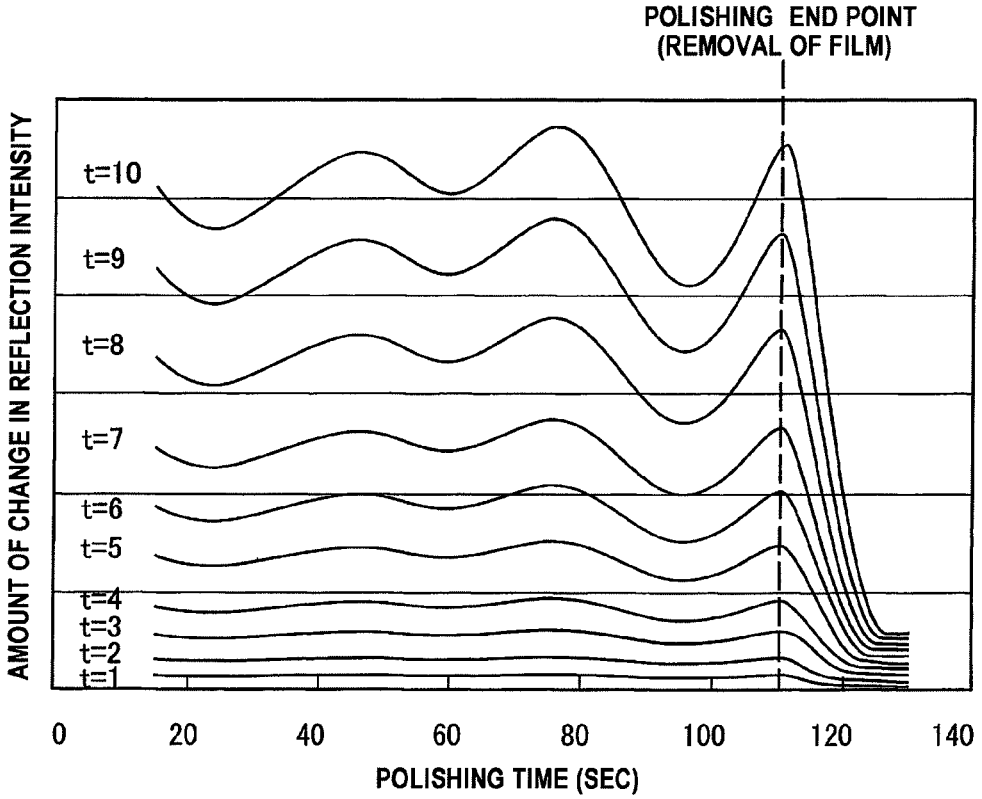
FIG. 7 is a graph showing the amount of change in reflection intensity varying depending on a parameter t that determines a time interval between two spectral profiles.

The time intervals between the two spectral profiles to be compared are specified by the parameter t, as described above. FIG. 7 is a graph showing the amount of change in the reflection intensity varying depending on the parameter t that represents the time intervals between the two spectral profiles. As the parameter t increases, the difference in shape between the two spectral profiles becomes greater. Therefore, as can be seen from FIG. 7, during polishing, the amount of change in the reflection intensity remains at relatively large values, and is lowered greatly when the polishing rate is lowered. This means that establishment of the threshold value for the polishing endpoint detection is easy and that false detection of the polishing endpoint is less likely to occur. However, when the parameter t is large, it takes more time to calculate each amount of change in the reflection intensity. This means that a period of time from an actual polishing endpoint (removal of the film) to the polishing endpoint detection becomes long.

On the other hand, when the parameter t is small, the delay time of the polishing endpoint detection, i.e., the period of time from an actual polishing endpoint (removal of the film) to the polishing endpoint detection, is shortened. However, as shown in FIG. 7, the whole values of the amount of change in the reflection intensity decrease. As a result, a distance to the threshold value is shortened, and the false detection of the polishing endpoint is more likely to occur. In this manner, there is a trade-off relationship between the time required for the polishing endpoint detection and the accuracy of the polishing endpoint detection. Therefore, it is preferable to determine the parameter t in consideration of both the time required for the polishing endpoint detection and the accuracy of the polishing endpoint detection.

Figure 8A:
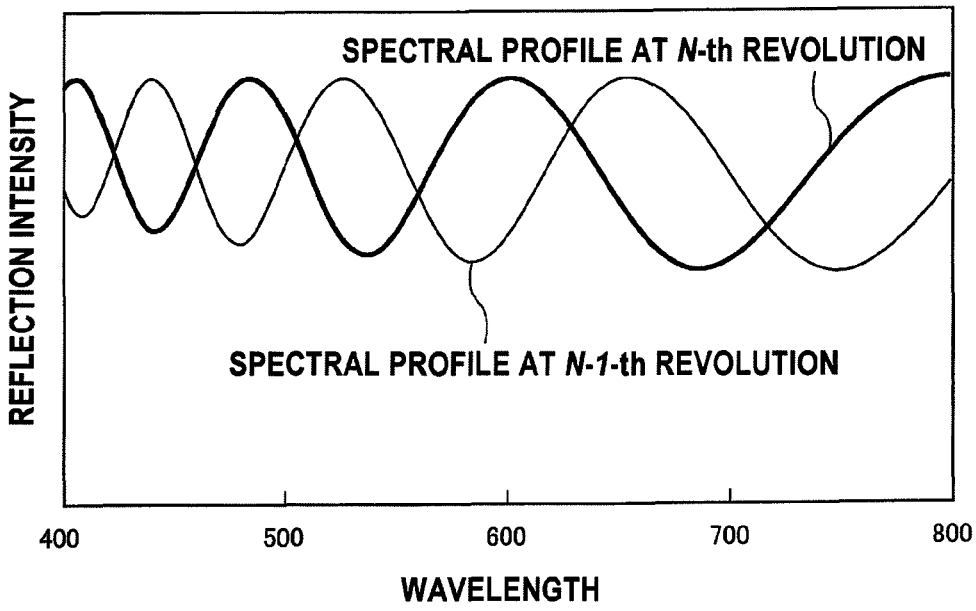
FIG. 8A is a graph showing two spectral profiles that are shifted in phase from each other by a half cycle.

When the parameter t is large to a certain degree, the phase of the spectral profile at the N-th revolution and the phase of the spectral profile at the N−t-th revolution are shifted from each other by a half cycle, as shown in FIG. 8A. One of the two spectral profiles shown in FIG. 8A is a spectral profile when the polishing table 20 is making the N-th revolution, and the other is a spectral profile when the polishing table 20 is making the N−t-th revolution. As can be seen from FIG. 8A, the difference in the reflection intensity shows a maximum value when the phases of the two spectral profiles are shifted from each other by a half cycle (or an integral multiple of a half cycle).

Figure 8B:
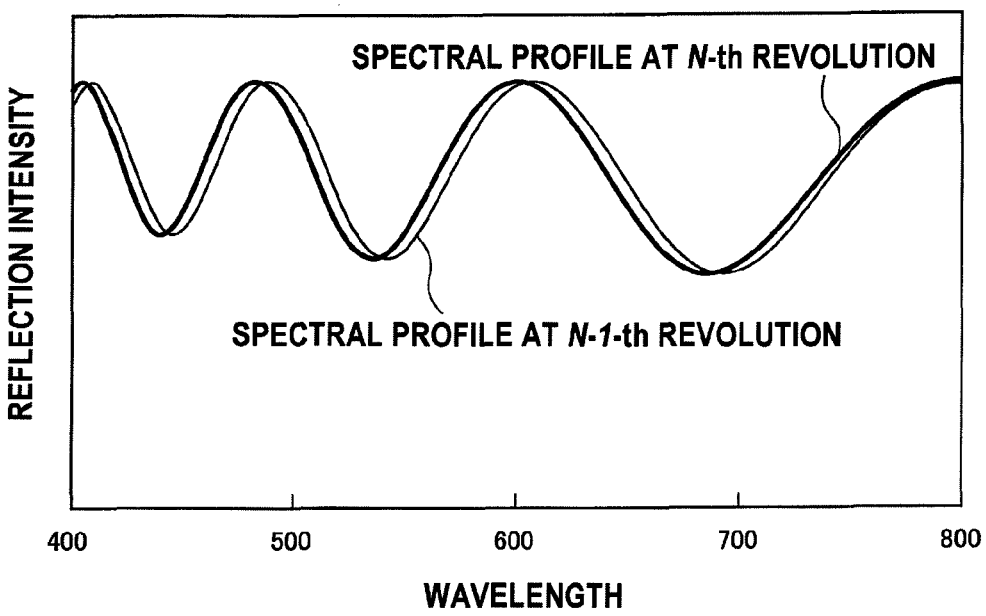
FIG. 8B is a graph showing the spectral profiles in FIG. 8A when the polishing rate is lowered.

On the other hand, when the polishing rate is lowered as a result of removal of the upper film, the phase difference between the two spectral profiles approaches zero. FIG. 8B is a graph showing spectral profiles in FIG. 8A when the polishing rate is lowered. When the polishing rate is lowered greatly, the shape of the spectral profile hardly changes. Consequently, as shown in FIG. 8B, the phase difference between the two spectral profiles approaches zero, and the difference in the reflection intensity becomes small.

In the case where the parameter t as shown in FIG. 8A and FIG. 8B is selected, the amount of change in the reflection intensity does not fluctuate greatly and remains at relatively large values before the polishing rate is lowered. On the other hand, the amount of change in the reflection intensity is lowered sharply when the polishing rate is lowered. Therefore, establishment of the threshold value for determining the polishing endpoint is easy. As a result, the false detection of the polishing endpoint can be avoided. From such a viewpoint, it is preferable to select the parameter t such that the phase of the spectral profile at the N-th revolution and the phase of the spectral profile at the N−t-th revolution are shifted from each other by a half cycle (or an integral multiple of a half cycle).

Further, as can be seen from FIG. 8A, the phase difference between the two spectral profiles can vary depending on the wavelength. Therefore, it is preferable to select the wavelength such that the phase of the spectral profile at the N-th revolution and the phase of the spectral profile at the N−t-th revolution are shifted from each other by a half cycle (or an integral multiple of a half cycle). In the example shown in FIG. 8A, when the wavelength is in the range of 400 nm to 500 nm, the phase difference between the spectral profiles is approximately a half cycle. Therefore, it is preferable to select the wavelength from this wavelength range.

Figure 9:
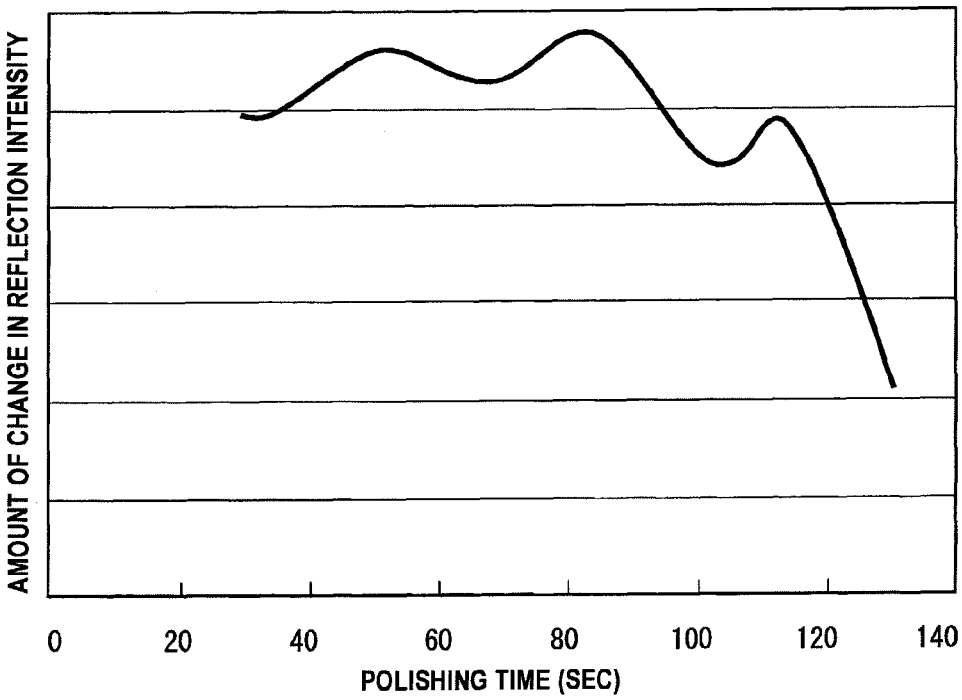
FIG. 9 is a graph showing the amount of change in reflection intensity in a case where the parameter t and multiple wavelengths are selected such that a phase difference between the two spectral profiles to be compared is approximately a half cycle.

FIG. 9 is a graph showing the amount of change in the reflection intensity in a case where the parameter t and the wavelengths are selected such that the phase difference between the two spectral profiles to be compared is approximately a half cycle. A vertical axis in FIG. 9 represents the amount of change in the reflection intensity, and a horizontal axis represents polishing time. FIG. 9 shows an example in which the parameter t is 25. As can be seen from FIG. 9, the amount of change in the reflection intensity does not fluctuates greatly before the polishing rate is lowered, compared with the case shown in FIG. 5 (i.e., the parameter t=10). Further, when the polishing rate is lowered, the amount of change in the reflection intensity is lowered sharply. Therefore, the false detection of the polishing endpoint can be reliably prevented.

In the above example, the difference in the reflection intensity between the spectral profiles, which are selected as one pair, is calculated. It is also possible to calculate differences in the reflection intensity from a plurality of pairs of the spectral profiles. In the case of using the plurality of pairs of the spectral profiles, two or more parameters t are selected. In this case also, each pair of the spectral profiles is composed of two spectral profiles including the latest spectral profile. For example, in the case where three pairs of spectral profiles are to be selected, a first pair consists of the latest spectral profile (at the N-th revolution) and a spectral profile previously obtained (at the N−1-th revolution), a second pair consists of the latest spectral profile (at the N-th revolution) and another spectral profile previously obtained (at the N−5-th revolution), and a third pair consists of the latest spectral profile (at the N-th revolution) and still another spectral profile previously obtained (at the N−10-th revolution). The difference in the reflection intensity is calculated for each pair.

As with the example described above, the difference, calculated for each pair, is squared, whereby a plurality amounts of change in the reflection intensity are obtained. The aforementioned graph in FIG. 7 indicates the multiple amounts of change in the reflection intensity obtained from multiple pairs of spectral profiles. The multiple amounts of change in the reflection intensity thus obtained may be monitored individually, or the sum or average of the multiple amounts of change in the reflection intensity may be monitored. In the case of monitoring the multiple amounts of change individually, a point of time when a predetermined number of amounts of change have reached threshold value(s) can be determined to be the polishing endpoint. In this case, the threshold value may be a single threshold value which is common to the respective pairs, or threshold values may be provided for the multiple pairs, respectively. In the case of monitoring the sum or average of the multiple amounts of change, a point of time when the sum or average thereof has reached a predetermined threshold value can be determined to be the polishing endpoint.

Further, it is also possible to calculate changing speeds from the plurality of amounts of the change obtained from the plurality of pairs of the spectral profiles and a plurality of time intervals determined by the corresponding parameters t and to determine the polishing endpoint from changing speed lines indicating that the changing speeds are approaching zero. For example, a point of time when at least one of the changing speeds has reached a predetermined threshold value can be determined to be the polishing endpoint. Further, a sum or an average of the plurality of the changing speeds may be monitored.

The reflection intensity may be expressed as a spectral index (SI) which is defined by the following equation.

$$SI = \sum_{\lambda=p}^{q} [ref(\lambda)/(ref(\lambda) + ref(\lambda + C))] \tag{2}$$

In the above equation, ref (λ) represents a reflection intensity at a wavelength λ determined from the spectral profile, C represents a constant, p represents a lower limit of a predetermined wavelength range, and q is a value determined by subtracting the constant C from an upper limit of the predetermined wavelength range.

For example, where C is 100 and the wavelength range is from 400 nm to 800 nm, the above equation (2) is as follows.

$$SI = \sum_{\lambda=400}^{700} [ref(\lambda)/(ref(\lambda) + ref(\lambda + 100))] \tag{3}$$

As can be seen from the equation (2) and the equation (3), the spectral index SI is calculated using the reflection intensities at a plurality of wavelengths. In order to obtain a stable spectral index with less noise, it is preferable to select at least 100 wavelengths. It is more preferable to select 300 or more wavelengths. For example, in the case where a measurable wavelength range of the spectroscope 13 (see FIG. 3A) is from 400 nm to 800 nm, it is preferable to calculate the spectral index using the reflection intensities obtained over the whole wavelength range.

Where the parameters t are 6 to 10 and multiple pairs of spectral profiles are used, the amount of change in the reflection intensity is as follows.

$$\sum_{t=6}^{10} [SI(N) - SI(N - t)]^2 \tag{4}$$

In the above, SI(N) represents a spectral index calculated from the spectral profile obtained when the polishing table is making N-th revolution.

The spectral index (SI) is, as can be seen from the equation (3), obtained by dividing reflection intensity at a certain wavelength by reflection intensity at another wavelength. By dividing reflection intensity by reflection intensity in this manner, the amount of change in the reflection intensity fluctuates greatly, and further noise components contained in the reflection intensity are reduced. As a result, the waveform, described by the amount of change in the reflection intensity, is emphasized and stabilized, and therefore the accuracy of the polishing endpoint detection is improved.

Figure 10:
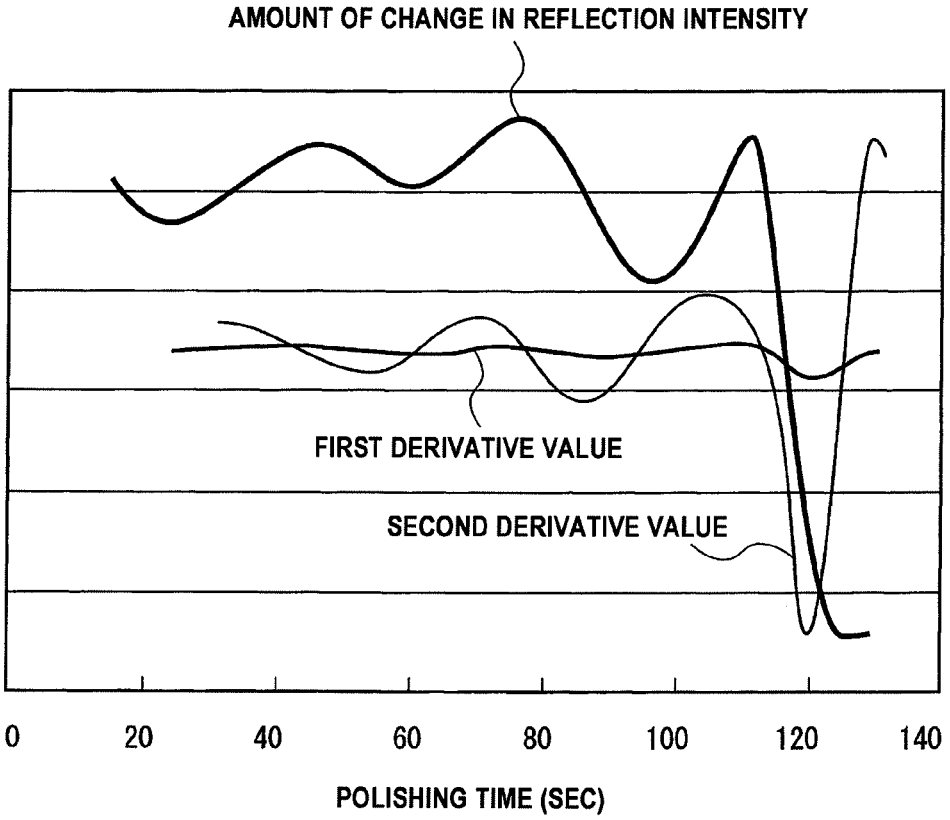
FIG. 10 is a graph showing a manner in which the amount of change in the reflection intensity, a first derivative value, and a second derivative value fluctuate according to polishing time.

The amount of change in the reflection intensity may be differentiated to provide a first derivative value, and the polishing endpoint may be determined based on whether or not the first derivative value has reached a predetermined threshold value. Further, a second derivative value of the amount of change in the reflection intensity may be calculated, and the polishing endpoint may be determined based on whether or not the second derivative value has reached a predetermined threshold value. FIG. 10 is a graph showing a manner in which the amount of change in the reflection intensity, the first derivative value, and the second derivative value fluctuate according to polishing time. As can be seen from this graph, the amount of change in the reflection intensity, the first derivative value, and the second derivative value change greatly at substantially the same point of time. Therefore, the amount of change in the reflection intensity and the first derivative value and/or the second derivative value may be monitored, and the polishing endpoint may be determined by detecting a point of time when all of them have reached the respective threshold values.

There is a conventional polishing endpoint detection method in which a spectral data of a reference substrate is obtained in advance as a reference data and the polishing endpoint is determined by comparing a spectral data of a product substrate and the reference data. However, in this method, the spectral data may vary from substrate to substrate because of a difference in film thickness due to error of measuring positions or because of a difference in density of interconnect patterns. Consequently, an accurate polishing endpoint detection may not be performed in this conventional method. According to the embodiment of the present invention, a spectral data (i.e., a spectral profile) of the product substrate itself is used as a reference data. Therefore, the accuracy of the polishing endpoint detection is improved.

In the above-described polishing endpoint detection method, a relative reflectance may be used instead of the reflection intensity. The relative reflectance is a ratio of the intensity of the reflected light (i.e., the measured reflection intensity−a background intensity) to a reference intensity of the light (i.e., a reference reflection intensity−the background intensity). The relative reflectance is determined by subtracting the background intensity (which is a dark level obtained under conditions where no reflecting object exists) from both the reflection intensity at each wavelength (which is measured during polishing of the substrate) and the reference reflection intensity at each wavelength (which is obtained under predetermined conditions) to determine the actual intensity and the reference intensity and dividing the actual intensity by the reference intensity. More specifically, the relative reflectance is obtained by using $$\text{the relative reflectance } R(\lambda)=[E(\lambda)-D(\lambda)]/[B(\lambda)-D(\lambda)] \quad (5)$$

where λ is a wavelength, E(λ) is a reflection intensity with respect to a substrate as an object to be polished, B(λ) is the reference reflection intensity, and D(λ) is the background intensity (dark level) obtained under conditions where the substrate does not exist. The reference reflection intensity B(λ) may be an intensity of reflected light from a silicon wafer when water-polishing the silicon wafer while supplying pure water onto the polishing pad. In this case, instead of the silicon wafer, a wafer having a film whose refractive index (n) and absorption coefficient are stable may be used.

Figure 11:
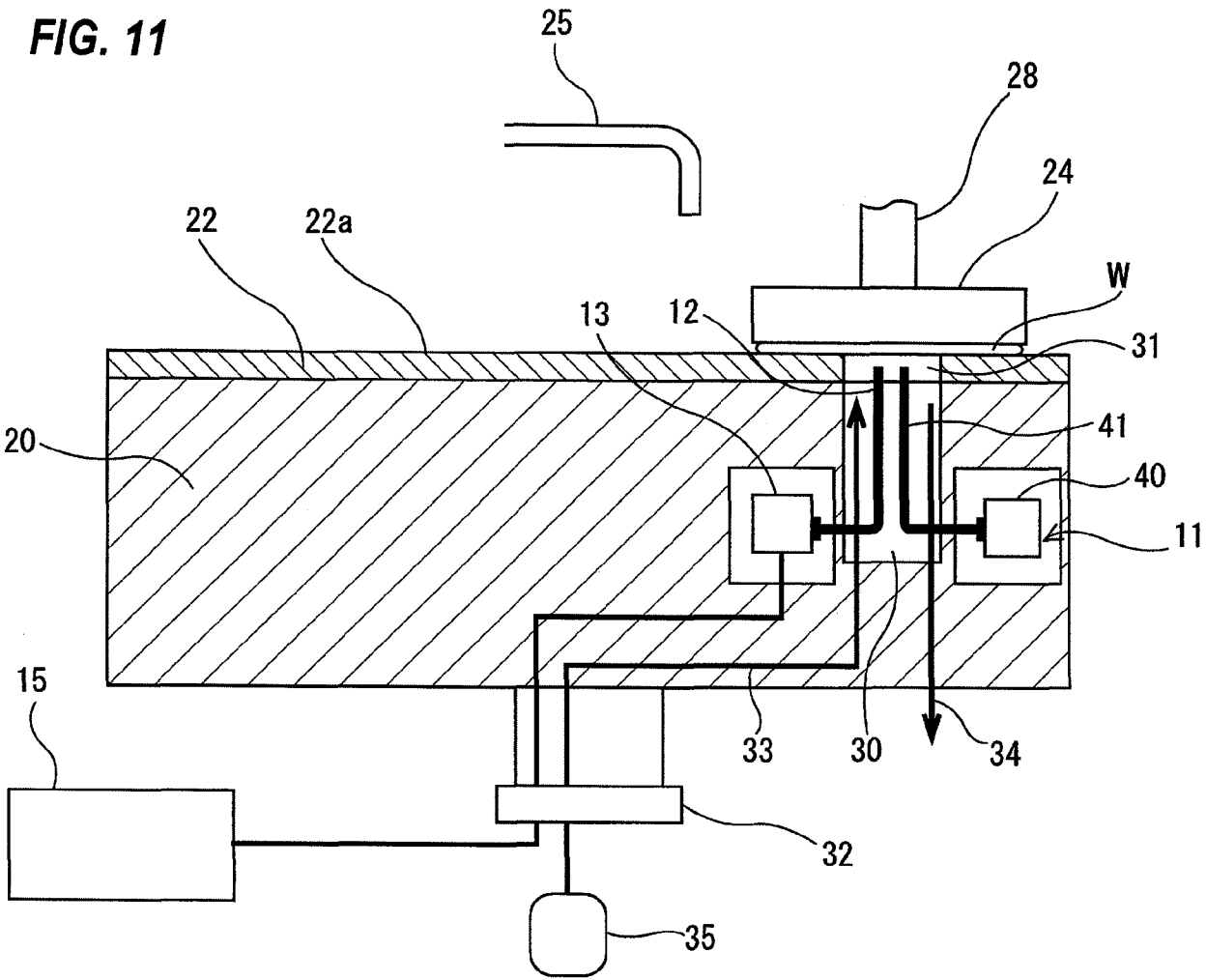
FIG. 11 is a cross-sectional view schematically showing a polishing apparatus.

Next, a polishing apparatus having a polishing endpoint detection unit will be described. FIG. 11 is a schematic cross-sectional view showing the polishing apparatus. As shown in FIG. 11, the polishing apparatus includes the polishing table 20 supporting a polishing pad 22, a top ring 24 configured to hold a substrate W and to press the substrate W against the polishing pad 22, and a polishing liquid supply nozzle 25 configured to supply a polishing liquid (slurry) onto the polishing pad 22. The polishing table 20 is coupled to a motor (not shown in the drawing) provided below the polishing table 20, so that the polishing table 20 can be rotated about its own axis. The polishing pad 22 is secured to an upper surface of the polishing table 20.

The polishing pad 22 has an upper surface 22*a*, which provides a polishing surface for polishing the substrate W. The top ring 24 is coupled to a motor and an elevating cylinder (not shown in the drawing) via a top ring shaft 28. This configuration allows the top ring 24 to move vertically and to rotate about the top ring shaft 28. The top ring 24 has a lower surface which is configured to hold the substrate W by a vacuum suction or the like.

The substrate W, held on the lower surface of the top ring 24, is rotated by the top ring 24, and is pressed against the polishing pad 22 on the rotating polishing table 20. During the sliding contact between the substrate W and the polishing pad 22, the polishing liquid is supplied onto the polishing surface 22*a* of the polishing pad 22 from the polishing liquid supply nozzle 25. The surface of the substrate W is polished with the polishing liquid present between the surface of the substrate W and the polishing pad 22. In this embodiment, a relative movement mechanism for providing the sliding contact between the surface of the substrate W and the polishing pad 22 is constructed by the polishing table 20 and the top ring 24.

The polishing table 20 has a hole 30 whose upper end lying in the upper surface of the polishing table 20. The polishing pad 22 has a through-hole 31 at a position corresponding to the hole 30. The hole 30 and the through-hole 31 are in fluid communication with each other. An upper end of the through-hole 31 lies in the polishing surface 22*a*. A diameter of the through-hole 31 is about 3 to 6 mm. The hole 30 is coupled to a liquid supply source 35 via a liquid supply passage 33 and a rotary joint 32. During polishing, the liquid supply source 35 supplies water (preferably pure water) as a transparent liquid into the hole 30. The pure water fills a space formed by a lower surface of the substrate W and the through-hole 31, and is then expelled therefrom through a liquid discharge passage 34. The polishing liquid is discharged with the water and thus a path of the light is secured. The liquid supply passage 33 is provided with a valve (not shown in the drawing) configured to operate in conjunction with the rotation of the polishing table 20. The valve operates so as to stop the flow of the water or reduce the flow of the water when the substrate W is not located above the through-hole 31.

The polishing apparatus has the polishing endpoint detection unit for detecting a polishing endpoint according to the above-described method. This polishing endpoint detection unit includes the light-applying unit 11 configured to apply the light to the surface of the substrate W, an optical fiber 12 as the light-receiving unit configured to receive the reflected light from the substrate W, the spectroscope 13 configured to decompose the reflected light, received by the optical fiber 12, according to the wavelength and to produce the spectral profile, and the monitoring unit 15 configured to determine the amount of change in the reflection intensity from the spectral profile obtained by the spectroscope 13 and to monitor the amount of change in the reflection intensity. As described above, this monitoring unit 15 detects the polishing endpoint based on the amount of change in the reflection intensity.

The light-applying unit 11 includes a light source 40 and an optical fiber 41 coupled to the light source 40. The optical fiber 41 is a light-transmitting element for directing the light from the light source 40 to the surface of the substrate W. The optical fiber 41 extends from the light source 40 into the through-hole 31 through the hole 30 to reach a position near the surface of the substrate W to be polished. The optical fiber 41 and the optical fiber 12 have tip ends, respectively, facing the center of the substrate W held by the top ring 24, so that the light is applied to regions including the center of the substrate W each time the polishing table 20 rotates. In order to facilitate replacement of the polishing pad 22, the tip ends of the optical fibers 41 and 12 may be positioned in the hole 30 so that the optical fibers 41 and 12 do not protrude from the upper surface of the polishing table 20.

A light emitting diode (LED), a halogen lamp, a xenon lamp, and the like can be used as the light source 40. The optical fiber 41 and the optical fiber 12 are arranged in parallel with each other. The tip ends of the optical fiber 41 and the optical fiber 12 are arranged so as to face in a direction perpendicular to the surface of the substrate W, so that the optical fiber 41 directs the light to the surface of the substrate W in the perpendicular direction.

During polishing of the substrate W, the light-applying unit 11 applies the light to the substrate W, and the optical fiber 12 as the light-receiving unit receives the reflected light from the substrate W. During the application of the light, the hole 30 is supplied with the water, whereby the space between the tip ends of the optical fibers 41 and 12 and the surface of the substrate W is filled with the water. The spectroscope 13 measures the intensity of the reflected light at each wavelength and produces the spectral profile. The monitoring unit 15 monitors the amount of change in the reflection intensity calculated from the spectral profile and determines the polishing endpoint by detecting a point of time when the amount of change has reached the predetermined threshold value.

Figure 12:
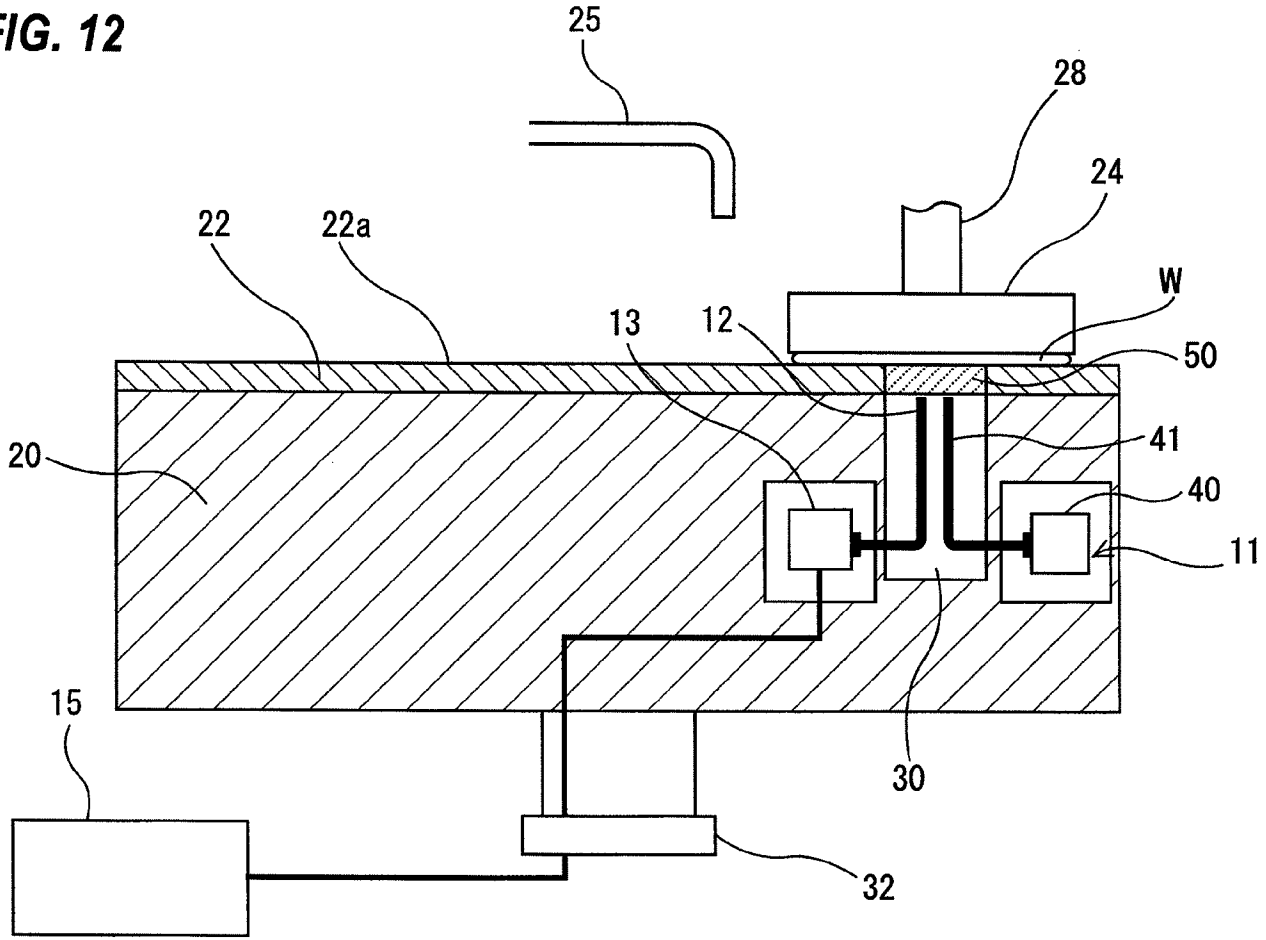
FIG. 12 is a cross-sectional view showing another modified example of the polishing apparatus.

FIG. 12 is a cross-sectional view showing another modified example of the polishing apparatus shown in FIG. 11. In the example shown in FIG. 12, the liquid supply passage, the liquid discharge passage, and the liquid supply source are not provided. Instead, a transparent window 50 is provided in the polishing pad 22. The optical fiber 41 of the light-applying unit 11 applies the light through the transparent window 50 to the surface of the substrate W on the polishing pad 22, and the optical fiber 12 as the light-receiving unit receives the reflected light from the substrate W through the transparent window 50. The other structures are the same as those of the polishing apparatus shown in FIG. 11.

Figure 13:
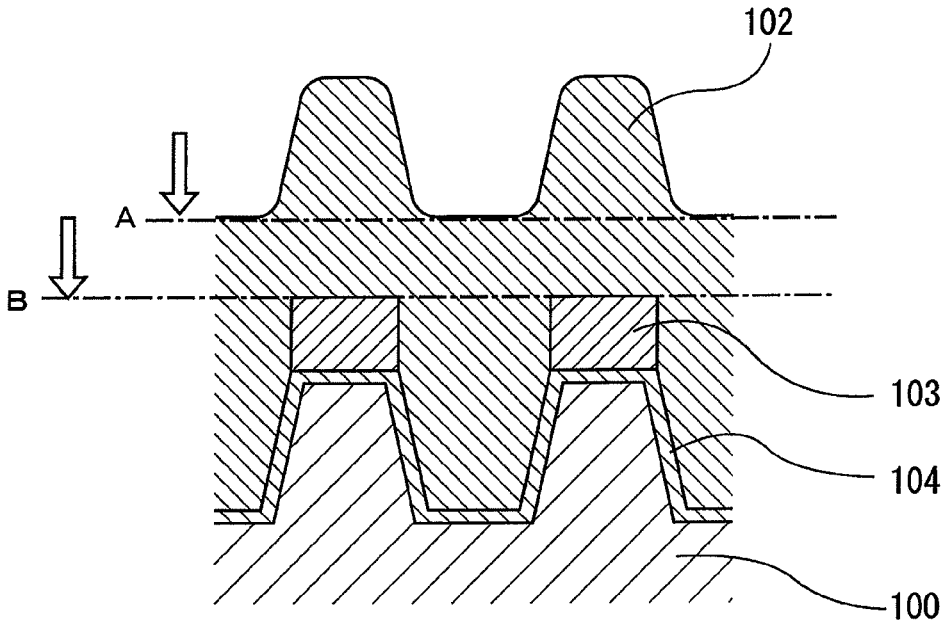
FIG. 13 is a cross-sectional view showing a process of STI.

The present invention can be applied to a STI (Shallow Trench Isolation) process, a polysilicon (Poly-Si) removal process, a barrier layer removal process, and the like. FIG. 13 is a cross-sectional view showing a process of STI and shows a state in which a $SiO_2$ film 102 as an insulating film is embedded in trenches formed in a silicon wafer 100. As shown in FIG. 13, a pad oxide film (Pad Oxide) 104 is formed between a surface of the silicon wafer 100 and the $SiO_2$ film 102, and a SiN film 103 is formed on portions of the pad oxide film 104 at which the trenches are not formed.

Figure 14:
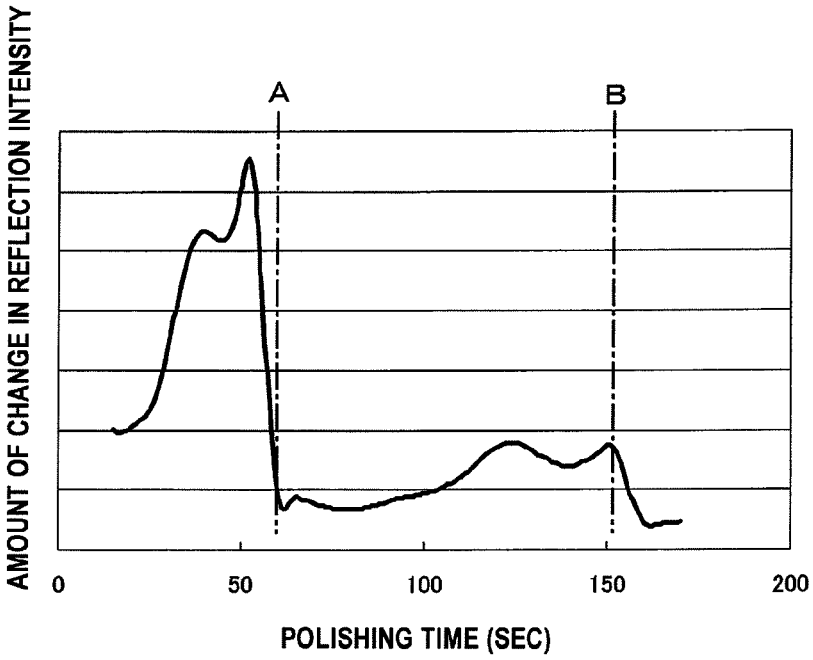
FIG. 14 is a graph showing a manner in which the amount of change in the reflection intensity fluctuates according to polishing time when polishing a substrate shown in FIG. 13.

The $SiO_2$ film 102 is polished by CMP until the SiN film 103, which is the lower film of the $SiO_2$ film 102, is exposed. Specifically, steps, i.e., uneven portions, formed on the surface of the $SiO_2$ film 102 are removed at an initial stage of polishing (the removal point is indicated by mark A), and the $SiO_2$ film 102 on the SiN film 103 is removed at a final stage of polishing (the removal point is indicated by mark B). FIG. 14 is a graph showing a manner in which the amount of change in the reflection intensity varies according to the polishing time when polishing the substrate shown in FIG. 13. In this example, the parameter t is set to 10. As can be seen from the graph in FIG. 14, when the steps (uneven portions) on the surface of the $SiO_2$ film 102 are removed (indicated by the mark A) and when the $SiO_2$ film 102 on the SiN film 103 is removed (indicated by the mark B), the amount of change in the reflection intensity (i.e., the polishing rate) is lowered. Therefore, the point of time when the SiN film 103 is exposed, i.e., the polishing endpoint, can be detected according to the polishing endpoint detection method of the present embodiment as described above.

Figure 15:
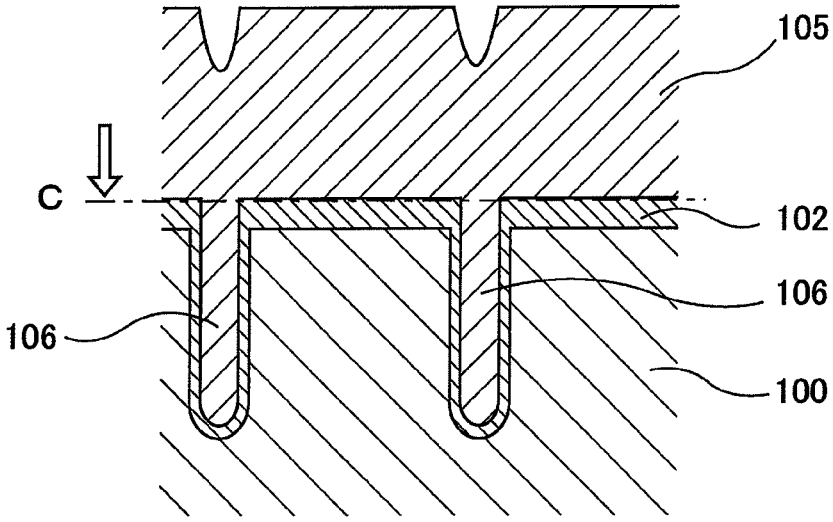
FIG. 15 is a cross-sectional view showing a structure of a substrate which is subjected to a CMP process for removing polysilicon (Poly-Si)

FIG. 15 is a cross-sectional view showing a structure of a substrate which is subjected to a CMP process for removing polysilicon (Poly-Si). More specifically, FIG. 15 shows a process of forming a deep trench capacitor. As shown in FIG. 15, a $SiO_2$ film 102 is formed on a surface of a silicon wafer 100 having deep trenches formed therein, and further a polysilicon film 105 is formed on the $SiO_2$ film 102. The polysilicon film 105 is polished by CMP until the $SiO_2$ film 102, which is the underlying layer of the polysilicon film 105, is exposed. As a result, capacitors 106 made of the polysilicon are formed in the deep trenches. In FIG. 15, a removal point of the polysilicon film 105 is indicated by mark C.

Figure 16:
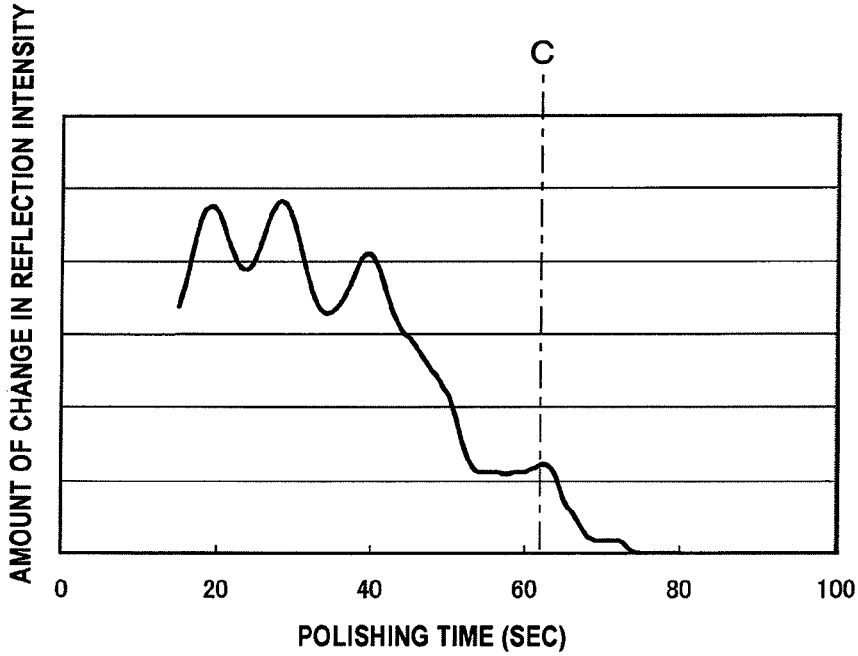
FIG. 16 is a graph showing a manner in which the amount of change in the reflection intensity fluctuates according to polishing time when polishing a substrate shown in FIG. 15.

FIG. 16 is a graph showing a manner in which the amount of change in the reflection intensity varies according to the polishing time when polishing the substrate shown in FIG. 15. In this example also, the parameter t is set to 10. As can be seen from the graph in FIG. 16, when the polysilicon film 105 on the $SiO_2$ film 102 is removed (indicated by the mark C), the amount of change in the reflection intensity (i.e., the polishing rate) is lowered. Therefore, a point of time when the $SiO_2$ film 102 is exposed, i.e., the polishing endpoint, can be detected according to the polishing endpoint detection method of the present embodiment as describe above.

Figure 17:
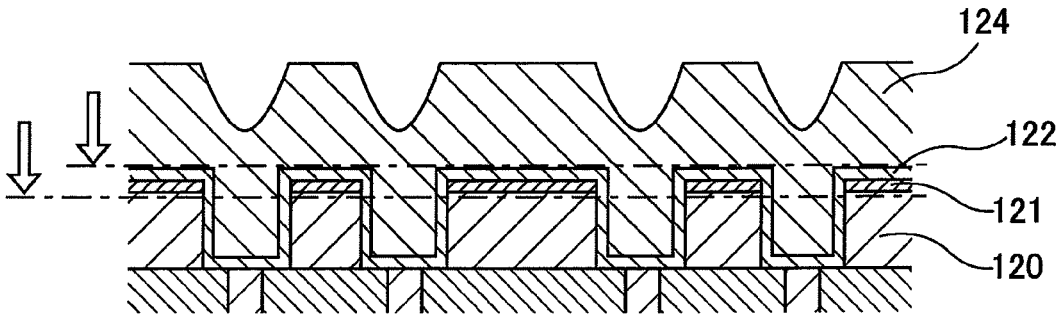
FIG. 17 is a cross-sectional view showing a structure of a substrate which is subjected to a CMP process for removing a barrier layer.

FIG. 17 is a cross-sectional view showing a structure of a substrate which is subjected to a CMP process for removing a barrier layer. As shown in FIG. 17, a $SiO_2$ film (a hard mask film) 121 is formed on a surface of a low-k film (an inter-level dielectric) 120. A Ta/TaN film (a barrier layer) 122 is formed on a surface of the $SiO_2$ film 121 and on surfaces of interconnect trenches formed in the low-k film 120. Further, a Cu film 124, forming metal interconnects, is formed on a surface of the Ta/TaN film 122.

The CMP process is divided mainly into two steps. The first polishing step is a process of removing the Cu film 124. This step is performed until the Ta/TaN film 122 is exposed. In this first polishing step, the polishing endpoint detection is typically performed using an eddy current sensor. The second polishing step is a process of removing the Ta/TaN film 122 and the $SiO_2$ film 121 so as to expose the low-k film 120. In the second polishing step, the polishing endpoint detection method according to the present embodiment described above is used.

Figure 18:
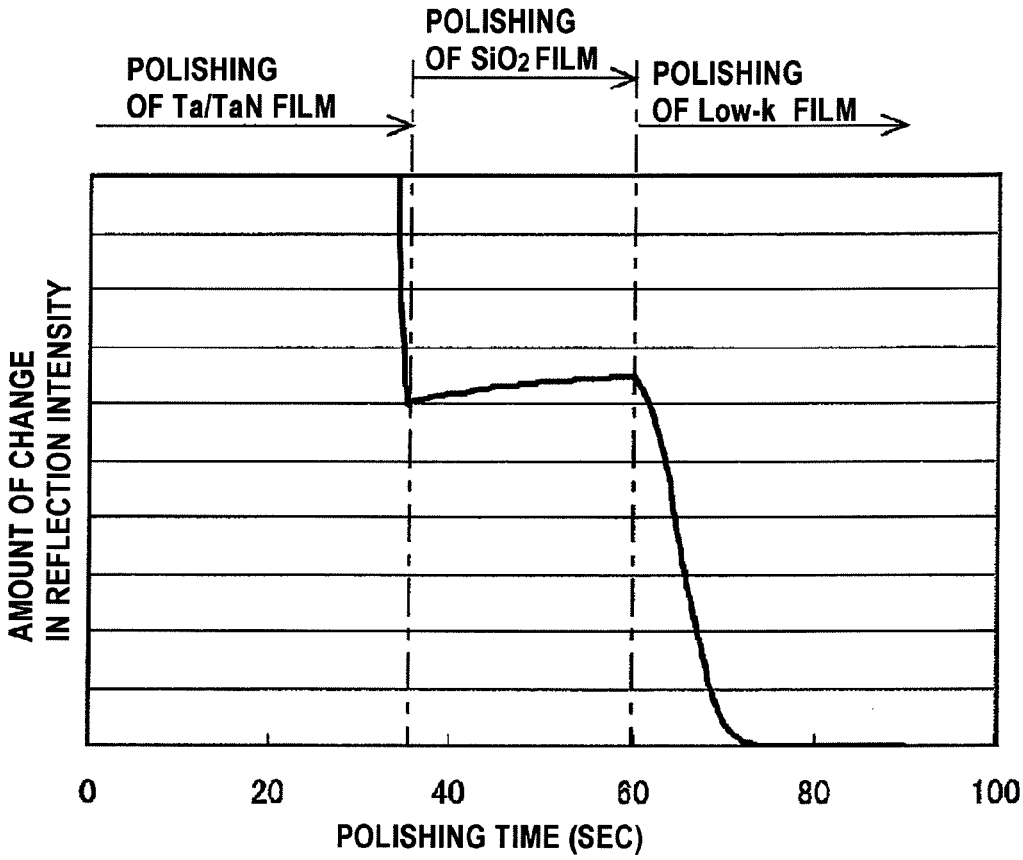
FIG. 18 is a graph showing a manner in which the amount of change in the reflection intensity fluctuates according to polishing time when polishing a substrate shown in FIG. 17.

FIG. 18 is a graph showing a manner in which the amount of change in the reflection intensity varies according to the polishing time when polishing the substrate shown in FIG. 17. The graph in FIG. 18 shows the amount of change in the reflection intensity when polishing the Ta/TaN film 122, the $SiO_2$ film 121, and the low-k film 120. In this example also, the parameter t is also set to 10. As can be seen from the graph in FIG. 18, when the $SiO_2$ film 121 as the hard mask film is removed and the low-k film 120 is exposed, the amount of change in the reflection intensity (i.e., the polishing rate) is lowered. Therefore, a point of time when the $SiO_2$ film 102 is exposed, i.e., the polishing endpoint, can be detected according to the polishing endpoint detection method of the present embodiment as describe above.

In this manner, the present invention can be applied to polishing of a combination of an upper film and a lower film with different polishing rates. Specifically, the polishing endpoint can be detected in both cases where the polishing rate of the upper film is higher than that of the lower film and where the polishing rate of the upper film is lower than that of the lower film.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. An apparatus for detecting a polishing endpoint of a substrate including a film, the apparatus comprising:

a light-applying unit configured to apply a light to a film-side surface of the substrate;

a light-receiving unit configured to receive a reflected light from the substrate;

a spectroscope configured to obtain a plurality of spectral profiles at predetermined time intervals, each spectral profile indicating reflection intensity at each wavelength of the reflected light; and a monitoring unit configured to monitor an amount of change in the reflection intensity obtained from the plurality of spectral profiles, wherein said monitoring unit is configured to select at least one pair of spectral profiles, including a latest spectral profile, from the plurality of spectral profiles obtained, calculate a difference in the reflection intensity at at least one predetermined wavelength between the spectral profiles selected, determine an amount of change in the reflection intensity from the difference, and determine a polishing endpoint based on the amount of change.

2. The apparatus according to claim 1, wherein said monitoring unit is configured to determine the polishing endpoint by detecting that the amount of change has reached a predetermined threshold value.

3. The apparatus according to claim 1, wherein said monitoring unit is configured to determine the amount of change in the reflection intensity by squaring the difference in the reflection intensity.

4. The apparatus according to claim 1, wherein:

the at least one predetermined wavelength is a plurality of predetermined wavelengths; and said monitoring unit is configured to determine the amount of change in the reflection intensity from a sum of differences in the reflection intensity at the plurality of predetermined wavelengths.

5. The apparatus according to claim 1, wherein:

the at least one pair of spectral profiles comprises a plurality of pairs of spectral profiles, each pair including the latest spectral profile; and said monitoring unit is configured to calculate a difference in the reflection intensity at the at least one predetermined wavelength between the spectral profiles in each of the plurality of pairs to obtain a plurality of differences in the reflection intensity for the plurality of pairs of spectral profiles, determine a plurality of amounts of change in the reflection intensity from the plurality of differences, calculate an average or a sum of the plurality of amounts of change, and determine the polishing endpoint based on the average or the sum.

6. The apparatus according to claim 1, wherein:

the at least one pair of spectral profiles comprises a plurality of pairs of spectral profiles, each pair including the latest spectral profile; and said monitoring unit is configured to calculate a difference in the reflection intensity at the at least one predetermined wavelength between the spectral profiles in each of the plurality of pairs to obtain a plurality of differences in the reflection intensity for the plurality of pairs of spectral profiles, determine a plurality of amounts of change in the reflection intensity from the plurality of differences, and determine the polishing endpoint by detecting that at least one of the plurality of amounts of change in the reflection intensity has reached a predetermined threshold value.

7. The apparatus according to claim 1, wherein said monitoring unit is configured to create a spectral index for each of the selected spectral profiles by dividing reflection intensity at the at least one predetermined wavelength by reflection intensity at another wavelength, calculate a difference in the spectral index between the spectral profiles selected, and determine the amount of change in the reflection intensity from the difference in the spectral index.

8. The apparatus according to claim 1, wherein said monitoring unit is configured to differentiate the amount of change in the reflection intensity that varies with polishing time to obtain a derivative value, and determine the polishing endpoint based on the amount of change in the reflection intensity and the derivative value.

9. The apparatus according to claim 1, wherein the predetermined time intervals are established such that a phase difference between the spectral profiles selected is approximately a half cycle.

10. The apparatus according to claim 9, wherein the at least one predetermined wavelength is selected from a wavelength range which is such that the phase difference between the spectral profiles selected is approximately a half cycle.

11. A polishing apparatus, comprising:

a polishing table for supporting a polishing pad;

a top ring configured to press a substrate having a film against the polishing pad; and the apparatus for detecting a polishing endpoint of the substrate according to claim 1.

* * * * *